US006565011B1

(12) United States Patent
Kuykendal et al.

(10) Patent No.: US 6,565,011 B1
(45) Date of Patent: May 20, 2003

(54) FOUNTAIN SHUTTER

(76) Inventors: Robert L. Kuykendal, 4118 Harbor Town, High Ridge, MO (US) 63049; Ronald S. Deichmann, 4997 Dover La., House Springs, MO (US) 63051

( * ) Notice: Subject to any disclaimer, the term of this patent is extended or adjusted under 35 U.S.C. 154(b) by 0 days.

(21) Appl. No.: 09/813,017

(22) Filed: Mar. 21, 2001

(51) Int. Cl.[7] ..... B05B 17/08

(52) U.S. Cl. ..... 239/17; 239/16; 239/DIG. 11; 251/65; 251/129.11

(58) Field of Search ..... 239/16, 17, 18, 239/22, 455, 505, 506, 507, 509, 511, 512, 581.1, DIG. 11; 310/40 R, 103, 152; 251/65, 129.11

(56) References Cited

U.S. PATENT DOCUMENTS 5,160,086 A * 11/1992 Kuykendal et al. ..... 239/18
5,597,119 A * 1/1997 Gorney et al. ..... 239/DIG. 11
5,641,120 A * 6/1997 Kuykendal et al. ..... 239/18
5,678,617 A * 10/1997 Kuykendal et al. ..... 239/16
6,179,228 B1 * 1/2001 Ramaker et al. ..... 239/17

* cited by examiner

*Primary Examiner*—Steven J. Ganey
(74) *Attorney, Agent, or Firm*—Henry W. Cummings

(57) ABSTRACT

This invention discloses an ornamental fountain wherein a fountain nozzle is made to discharge a pressurized stream of liquid, and a shutter prevents or allows the stream to exit.

5 Claims, 6 Drawing Sheets

FOUNTAIN SHUTTER

I FIELD OF THE INVENTION

This invention discloses an ornamental fountain wherein a fountain nozzle is made to discharge a pressurized stream of liquid, and a shutter prevents or allows the stream to exit.

II BACKGROUND OF THE INVENTION

U.S. Pat. No. 5,160,086 granted Nov. 3, 1992 is directed to a lighted laminar flow nozzle for use in decorative water fountains and industrial applications. It includes fluid flow through a double-walled bladder-like fluid supply hose 32 into a fluid chamber 10 and through a diffuser material 20, past trapped air pockets 18 and exiting through a knife edged orifice 12. The fluid nozzle is mounted upon one or more stages of vibration dampening springs 30, and the outlet orifice 12 is located off center from the walls 11 of the fluid chamber so that pump surges and vibrations are greatly dampened and the output fluid stream 14 is sufficiently laminar that light is conducted through the length of the output fluid stream 14 similar to a fiber optic cable.

U.S. Pat. No. 5,641,120 granted Jun. 24, 1997 is an improvement on the first described U.S. Pat. No. 5,160,086. This U.S. Pat. No. 5,641,120 includes an improved method and apparatus for obtaining a laminar stream of fluid flow including providing a generally cylindrical outer wall 13*a,* a generally cylindrical inner wall 14 defining a generally cylindrical outer chamber 13; introducing fluid into the outer chamber 13 tangentially at 12, directing fluid flow within the outer chamber circumferentially through chamber 13; providing an inner chamber 36 defined by the generally cylindrical inner wall located within or below the outer chamber 13. An opening 33 is formed in the lower portion of the inner cylindrical wall 14, which causes fluid to flow downwardly through the opening 33 from the outer chamber 13 into the inner chamber 36. Located within the inner chamber is a diffuser material having a plurality of parallel fluid flow paths. Fluid is caused to flow through the diffuser material to dampen major currents of fluid velocity. The diffuser material has an arcuate upper surface 84. Fluid is caused to flow radially inwardly from the arcuate surface through an orifice 20 located above the diffuser material to form a laminar fluid stream.

U.S. Pat. No. 5,678,617 granted Oct. 21, 1997, discloses a device located below a bar or counter whereby when the patron or guest orders a drink, the bartender or host places the drinking glass upon a designated location on the top of the bar or counter. Unknown to the patron or guest, the bartender activates a hidden control. The drink then appears to hop from some remote spot on the bar, take one or more leaps, and ultimately lands in the patron or guest's glass.

In FIGS. 1–1B a shutter is used to control the flow of a water stream with a solenoid controlled shutter.

III SUMMARY OF THE INVENTION

This invention discloses an ornamental fountain wherein a fountain nozzle 11 is made to discharge a pressurized stream of water, 12. The nozzle is placed behind a cover 10 with an exit aperture 1, and a shutter 2 prevents or allows the stream, 12, to exit, according to its rotational position around shaft, 9, and bearing, 15. The opening and closing of said shutter, 2, is controlled by armature, 3, with its tip, 14, composed of iron or other magnetic material. The armature, 3, is affixed to the rotational shaft, 9. The armature magnetic tip, 14, is positioned in close proximity to electromagnets 4, 5, 6 and 7 with their magnetic cores, 13, mounted on cover 10, such that the armature, 3, stays positioned against bumper, 8, whenever electromagnet, 4, remains activated. Consequently shutter 2 continues to block the exit port 1 and no water is discharged. By de-activating electromagnet, 4, and then sequentially activating electromagnet 5, then, 6, and then 7, the armature, 3, is made to rotate upon shaft, 9, and the shutter, 2, which is affixed to shaft 9 at 2*a* will move so that it is no longer blocking exit orifice, 1, and the stream will traverse through exit aperture 1 in the direction, 12. So long as pressurized water is made to flow from nozzle 11 and electromagnet, 7, remains energized, then the armature, 3, will remain positioned against bumper, 16, FIG. 3, and water will continue flowing in direction, 12. In order to stop the flow 12, electromagnet, 7, is deenergized and electromagnets 6, 5 and 4 are energized in sequence to move the armature, 3, in the direction of bumper, 8, to close shutter 2. In an alternate embodiment shown in FIGS. 4 and 5, the exit aperture, 1, the shutter, 2, and the rotating shaft, 9, are the same as in the previous embodiment. However, the means of rotating the shaft and opening the shutter utilize a plunger type electrical solenoid, 17, which retracts a plunger, 18, which is attached by a pin, 21, to a lever, 19, to overcome the force of a tension spring, 20, whenever the solenoid is electrically actuated as shown in FIG. 4. Upon de-activating the solenoid, as shown in FIG. 5, the force of the tension spring, 20, pulls the lever, 19, to withdraw the plunger, 18, rotate the shaft, 9, and close the shutter, 2.

IV THE DRAWINGS

DESCRIPTION OF PREFERRED EMBODIMENTS

Figure 1:
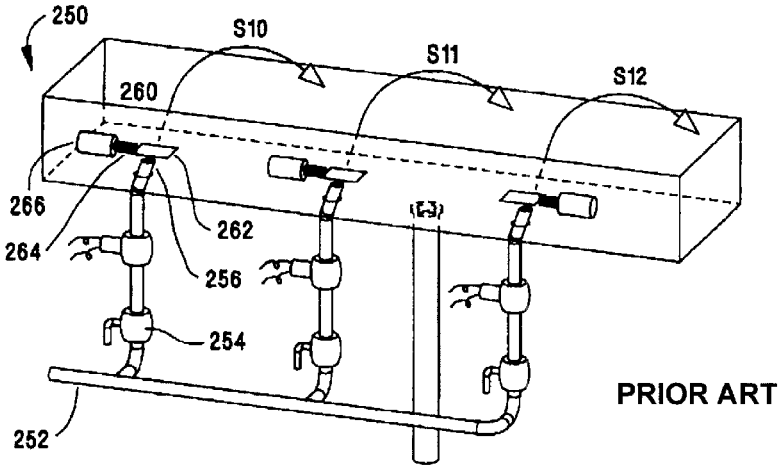
FIG. 1 is a perspective view of a prior art flow stream shutter used in a different environmoment in the closed position.
Figure 1A:
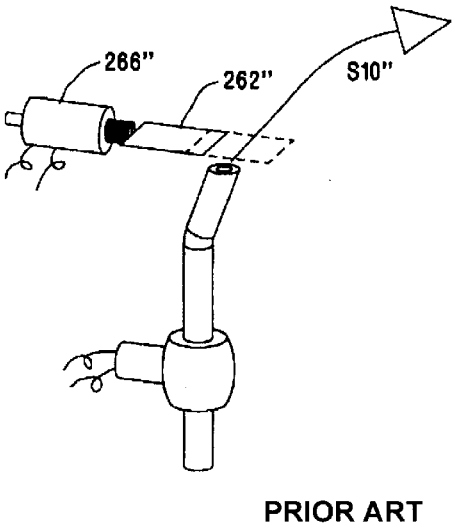
FIG. 1A is a perspective view of a prior art flow stream shutter used in a different environmoment in the open position.
Figure 1B:
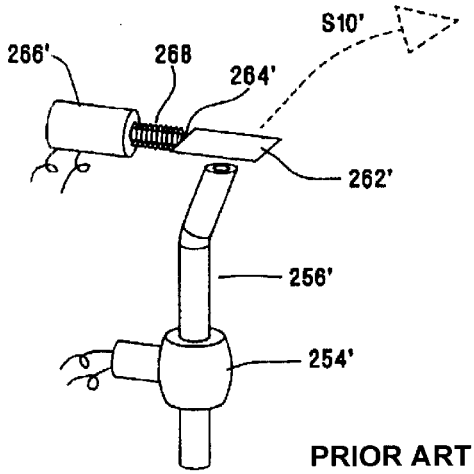
FIG. 1B is a perspective view of a prior art flow stream shutter used in a different environmoment in the closed position.

This invention discloses an ornamental fountain wherein a fountain nozzle 11 is made to discharge a pressurized stream of water, 12, in a manner well known in the fountain industry for example in accordance with U.S. Pat. Nos. 5,160,086 and 5,641,120 discussed above, and in Doc. Nos WW-11 entitled Minature Fountain and Doc. No. WW-12 Improved Laminar Nozzle, each hereby incorporated into the present application by this reference as if fully set forth herein.

The nozzle is placed behind a cover, 10, with an exit aperture, 1, and a shutter, 2, which prevents or allows the stream, 12, to exit, according to its rotational position around shaft, 9, and bearing, 15. The opening and closing of said shutter, 2, is controlled by armature, 3, with its tip, 14, composed of iron or other magnetic material. The armature, 3, is affixed to the rotational shaft, 9. The armature magnetic tip, 14, is positioned in close proximity to electromagnets 4, 5, 6 and 7 with their magnetic cores, 13, mounted on cover 10, with fasteners 24 such that the armature, 3, stays positioned against bumper, 8, whenever electromagnet, 4, remains activated and consequently shutter, 2, continues to block the exit port 1 and no water is discharged.

By de-activating electromagnet, 4, and then sequentially activating electromagnet 5, then, 6, and then 7, the armature, 3, is made to rotate upon shaft, 9, and the shutter, 2, which is affixed to shaft, 9, will move so that it is no longer blocking exit orifice, 1, and the stream will traverse through exit aperture, 1, in the direction, 12. So long as pressurized water is made to flow from nozzle, 11, and electromagnet, 7, remains energized, then the armature, 3, will remain positioned against bumper, 16, FIG. 3, and water will continue flowing in direction, 12.

In order to stop the flow 12, electromagnet, 7, is deenergized and electromagnets 6, 5 and 4 are energized in sequence to move the armature, 3, in the direction of bumper, 8, to close shutter 2.

Figure 2:
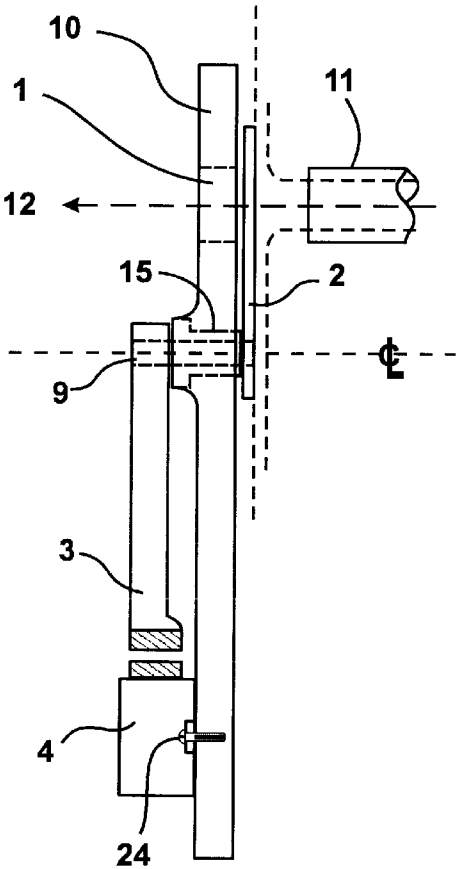
FIG. 2 is side elevation view of the fountain shutter of the present invention.
Figure 1C:
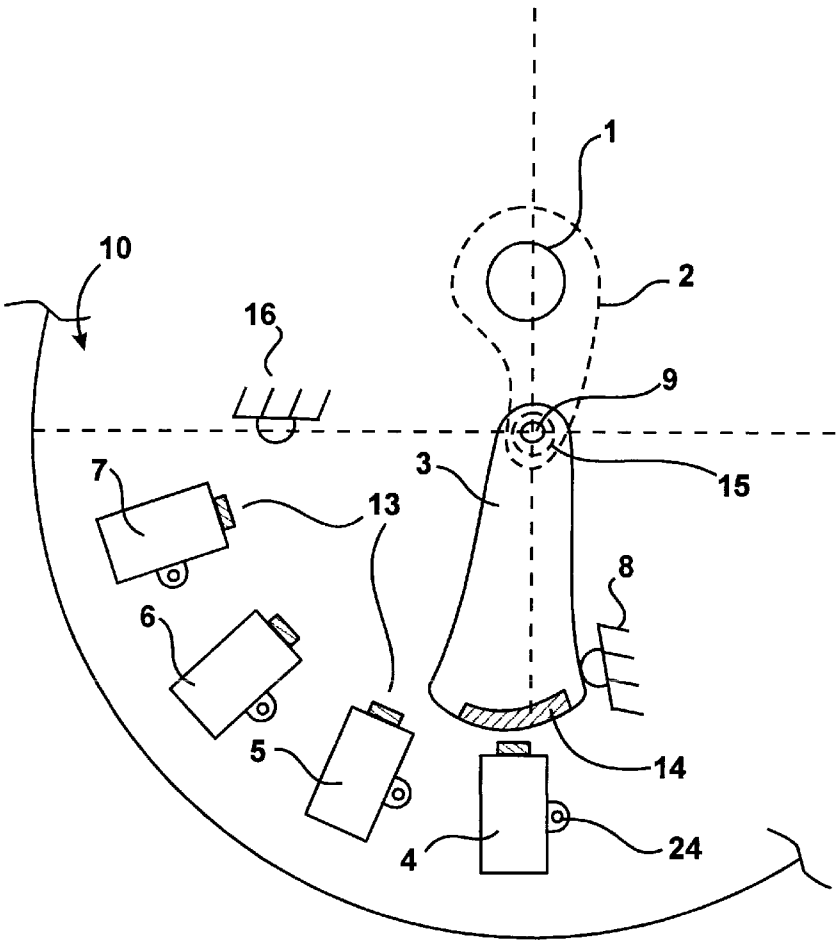
FIG. 1C is a front view of the fountain shutter of the present invention in the closed position.
Figure 3:
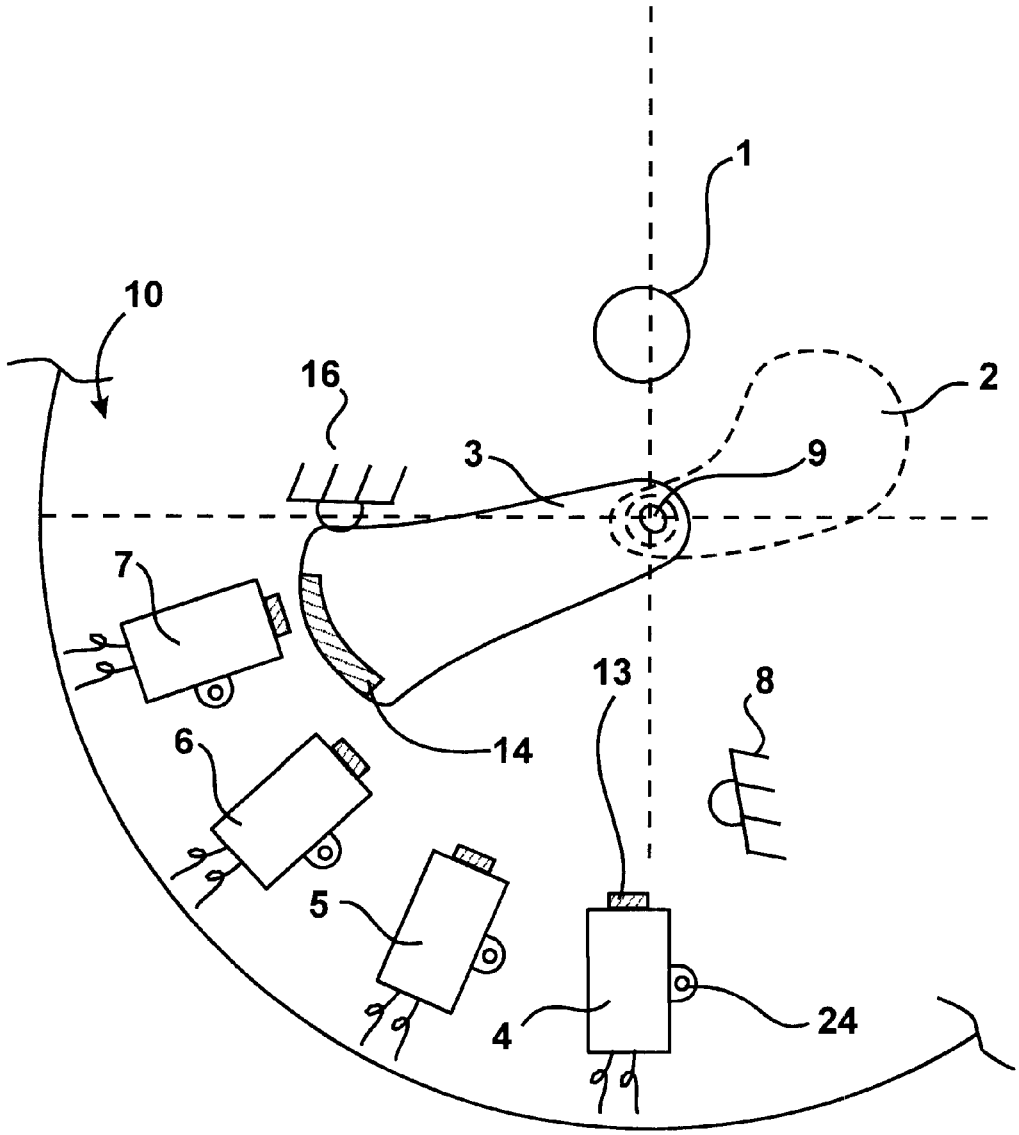
FIG. 3 is a front view of the fountain shutter of the present invention in the open position.

FIGS. 1C, 2 and 3 disclose four electromagnets but this embodiment may be made to work just as well with two or three or any number of electromagnets.

Figure 4:
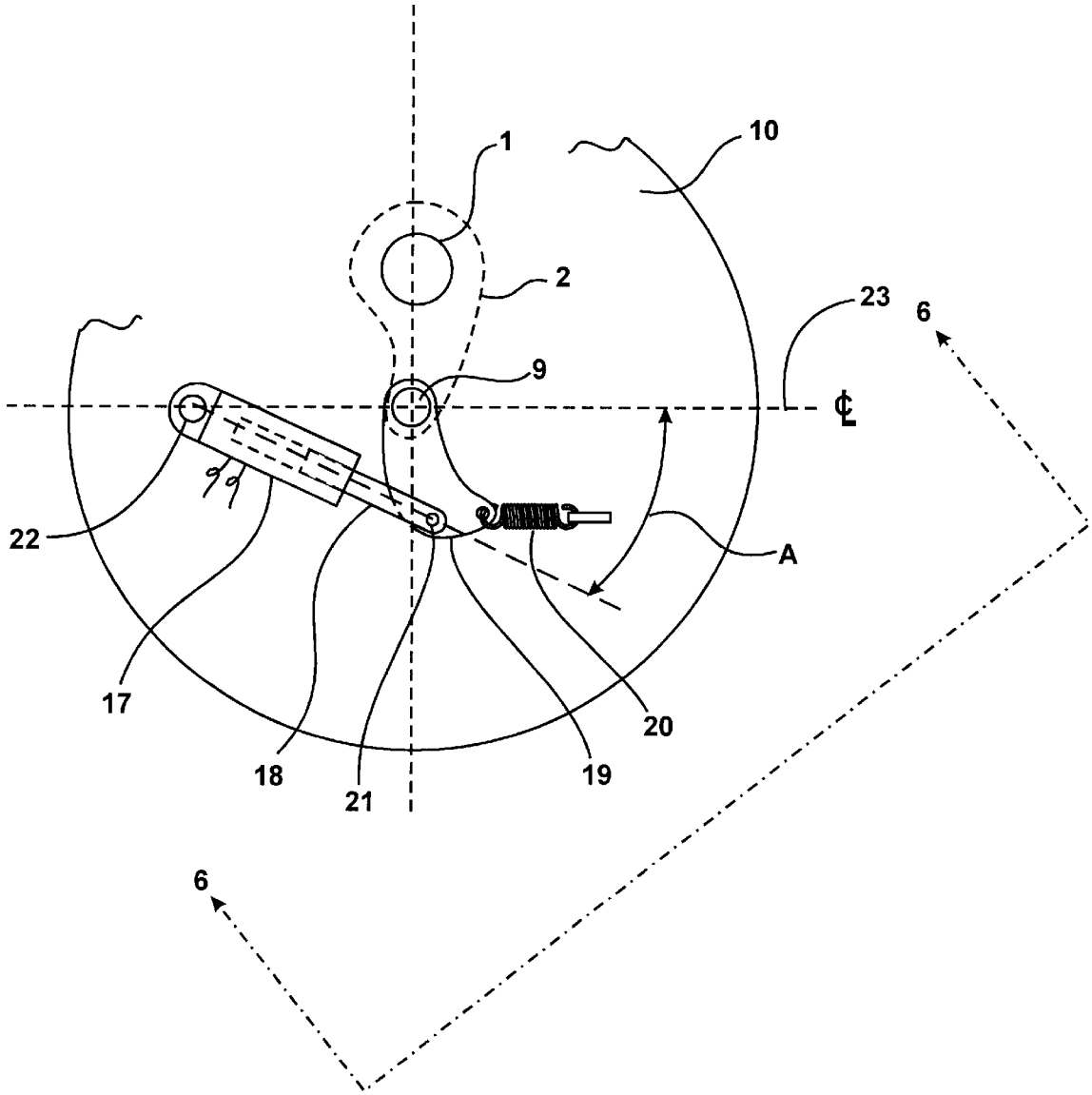
FIG. 4 is a front view of a second embodiment the of the present invention, with the shutter in the closed position.
Figure 5:
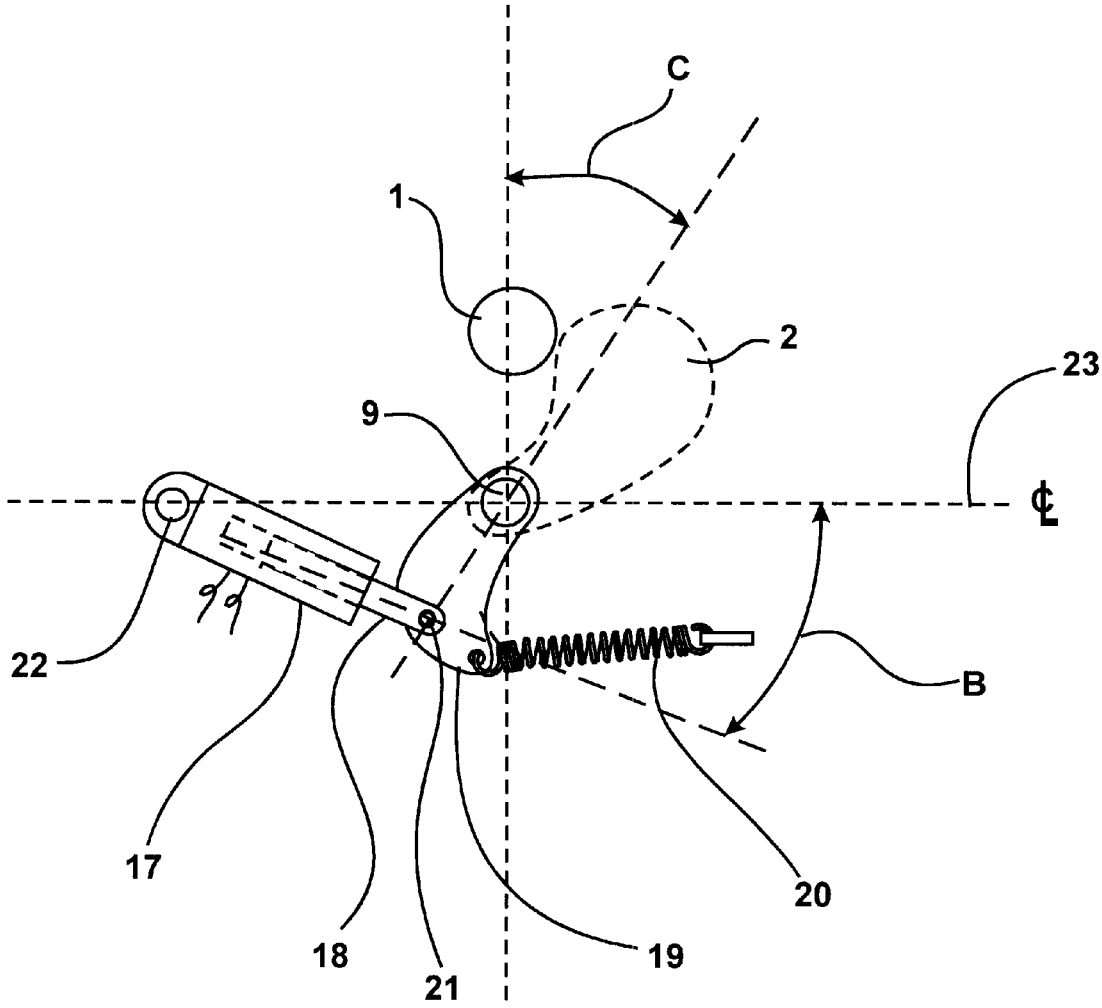
FIG. 5 is a side elevation view of the second embodiment the of the present invention, with the shutter in the open position.
Figure 6:
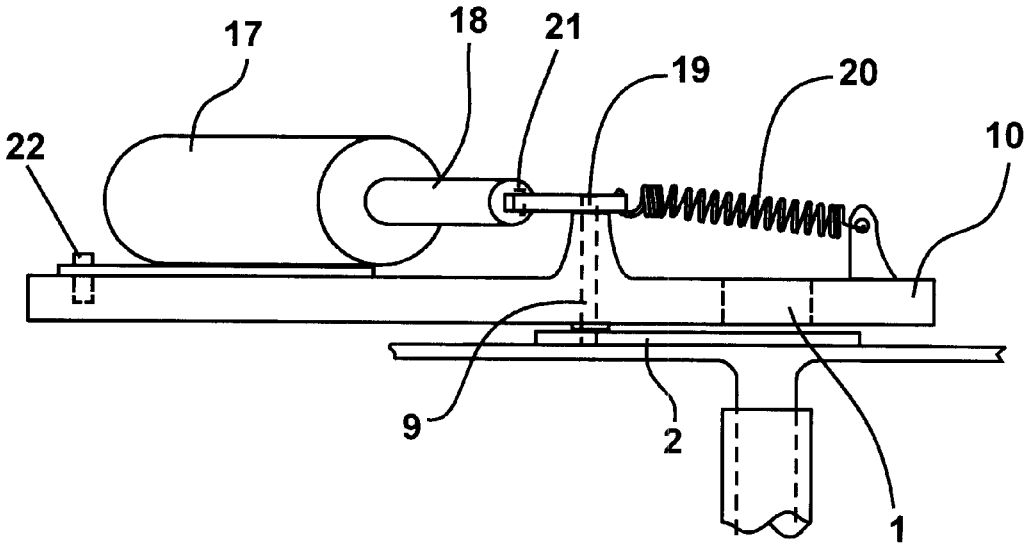
FIG. 6 is a view of the second embodiment the of the present invention, looking in the direction of the arrows along the line 6—6 in FIG. 4.

In an alternate embodiment shown in FIGS. 4 and 5, the exit aperture, 1, the shutter, 2, and the rotating shaft, 9, are the same as in the previous embodiment. However, the means of rotating the shaft and opening the shutter utilize a plunger type electrical solenoid, 17, which retracts a plunger, 18, which is attached by a pin, 21, to a lever, 19, to overcome the force of a tension spring, 20, whenever the solenoid is electrically actuated as shown in FIG. 5. The solenoid, 17, is mounted to the cover, 10, by means of a pivot, 22, which permits the solenoid and plunger to maintain proper alignment with pin 21, by rotation of a few degrees around pin 21 to compensate for the rotation of lever 19.

FIG. 4 shows solenoid 17 in deactivated position which consequently has allowed tension spring 20 to retract and withdraw plunger 18 from solenoid 17. This action has rotated lever 19 around shaft 9 to which it is affixed, and has rotated shutter 2, also affixed to shaft 9, into the closed position. Angle A shows the rotational position of the solenoid relative to the centerline 23, around pin 22.

FIG. 5 shows the solenoid 17 in an actuated condition, which has withdrawn plunger 18, and stretched spring 20 to rotate lever 19, pin 9 and shutter 2, through C degrees to uncover aperature 1, while the solenoid has rotated slightly around pin 22 to the extent of the angle B.

As an example, the angle A may be about 10 to about 45 degrees, the angle B may be about 5 to about 30 degrees and the angle B may be about 30 to about 60 degrees.

While solenoid plunger 18 has been described in the extended position when the shutter is in the blocking position, obviously this could be reversed and the plunger could be in the retracted position when the shutter is in the blocking position.

What is claimed is:

1. Control shutter assembly for a water fountain comprising:

a fountain nozzle having means to discharge a pressurized steam of water;

a shutter located adjacent said nozzle which prevents or allows said stream to exit;

said shutter integrally connect to a rotatable shaft;

an armature having a tip comprised of magnetic material at one end and at the other end affixed to the said rotatable shaft, whereby the opening and closing of said shutter is controlled by said armature;

a fixed stop located adjacent a blocking position of said armature;

at least two, first and second electromagnets having magnetic cores mounted adjacent said armature tip;

said armature tip positioned in close proximity said electromagnets such as in a first position said armature stays positioned against said stop whenever said first electromagnet remains activated, and said shutter continues to block said exit port and no water is discharged; and whereby by de-activating said first electromagnet and activating said second electromagnet, said armature is made to rotate said shaft and said shutter will rotate so that it is no longer blocking said exit orifice, and said stream will traverse through said exit aperture, and whereby in order to stop the flow said first electromagnet is energized and said second electromagnet is de-energized to move the armature in the direction of said stop to return said armature and said shutter to said first position.

2. A control shutter assembly according to claim 1 wherein more than one of said second electromagnets are provided.

3. A control shutter according to claim 2 wherein three of said second electromagnets are provided.

4. A control shutter according to claim 3 wherein said second electromagnets are mounted on said cover.

5. A control shutter assembly according to claim 1 wherein said shaft extends through a cover.

* * * * *